US005358446A

United States Patent [19]

Bergman

[11] Patent Number: 5,358,446

[45] Date of Patent: Oct. 25, 1994

[54] BOWLING RAMP

[76] Inventor: David Bergman, 27319 Aberdeen, Southfield, Mich. 48076

[21] Appl. No.: 104,713

[22] Filed: Aug. 11, 1993

[51] Int. Cl.[5] ..... A63D 5/00

[52] U.S. Cl. ..... 473/56; 473/103; 273/129 Q; 273/129 W

[58] Field of Search ..... 473/55, 56, 116, 106, 473/107; 273/129 Q, 129 AP, 129 V, 129 W

[56] References Cited

U.S. PATENT DOCUMENTS

| | | | |
|---|---|---|---|
| 3,215,436 | 11/1965 | Carter | 473/107 X |
| 4,097,045 | 6/1978 | Bechtel . | |
| 4,368,898 | 1/1983 | Lay | 280/289 WC |
| 4,441,710 | 4/1984 | Lay | 273/54 R |
| 4,470,598 | 9/1984 | Steele et al. | 273/54 R |
| 5,082,265 | 1/1992 | Bergman | 273/54 B |

*Primary Examiner*—Vincent Millin
*Assistant Examiner*—William M. Pierce
*Attorney, Agent, or Firm*—Brooks & Kushman

[57] ABSTRACT

A free standing bowling ramp for physically limited people is disclosed. The ramp includes supporting means, positioning and accelerating means, and means for aiming a bowling ball to target specific pins. The supporting means includes a number of interconnected components and flaps. The positioning and accelerating means includes first and second sloped parallel rails. The rails are sloped such as to prevent a ball from accidentally rolling down a ramp before the bowler intends to release the ball. The aiming means includes a clamp assembly that allows the bowler to reposition the ramp to target specific pins without shifting the entire ramp.

10 Claims, 4 Drawing Sheets

52
42
38
21
44
18

52
20
21
22
42
38
44
18

BOWLING RAMP

TECHNICAL FIELD

The present invention relates generally to an apparatus used for bowling, and more particularly, to a bowling ramp that allows people with physical limitations to bowl.

BACKGROUND ART

People with physical limitations, especially those confined to wheelchairs, often find it difficult or impossible to participate in many athletic and recreational activities for a myriad of reasons. One of the more obvious reasons is that without special equipment, the necessary physical movements needed to participate in the activity are beyond the capabilities of a physically limited person.

To bowl, a person confined to a wheelchair must move the wheelchair about while holding, positioning, and ultimately releasing a bowling ball. Due to the weight of the ball and difficulties encountered in swinging and releasing the ball in a specific direction, handicapped people may find it impossible to bowl effectively or consistently. Moreover, this movement is often beyond the capability and strength of the handicapped person. This is especially true with respect to young children and senior citizens. As a result, physically limited people may find it nearly impossible to bowl without assistance.

Typical bowling ramps, including both free standing and wheelchair attached, have been used by the handicapped for bowling. The ramps are typically positioned on the bowling lane, and are constructed in a way such as to roll the ball down the ramp toward the pins.

U.S. Pat. Nos. 4,368,898 and 4,441,710, issued to Lay, disclose bowling ramps for use by people confined to wheelchairs. The ramps extend in a declined manner from the seat area of the wheelchairs to the floor. The ramps may be either attached to the wheelchairs or free standing. Such prior art bowling ramps have many disadvantages. One disadvantage of these devices is that the bowler must shift the entire ramp to target specific bowling pins. The need to constantly shift the ramp makes it exceedingly difficult to target specific pins. Since there is neither an indicator nor a reference point on the ramp for repositioning the ramp, the bowler is required to guess as to the amount to shift the ramp in order to knock down specific pins.

A second disadvantage of these prior art devices is that the slopes of the ramps remain constant through the point where the ball comes into contact with the floor surface. Due to the abrupt change in slope which occurs during the transition of the ball from the ramp to the floor surface, the motion of the ball is not smooth. The ball may bounce and slow down considerably.

A third disadvantage of the prior art is that the bowling ramps do not safely accommodate bowling balls exceeding approximately ten pounds. Such prior art ramps may move or collapse resulting in potential injury to the bowler.

A fourth disadvantage of the prior art is that each of the ramps has only one place for positioning the ball. This requires all bowlers to exert the same amount of force to urge the ball down the ramp. People lacking sufficient strength to exert the necessary force are not able to make use of the ramp.

Thus, it would be desirable to provide a bowling ramp that overcomes the problems and limitations of the prior art such that the aiming process is as simple and accurate as possible, requiring minimal movement of the apparatus. It would also be desirable to provide a bowling ramp having a slope such that the ball would exit the ramp and smoothly proceed down the lane toward the pins. It would also be desirable to provide a bowling ramp that can be safely used with bowling balls of all standard weights. It would further be desirable to provide a bowling ramp with a plurality of ball positions enabling even the bowler of minimal strength to use the ramp. In conclusion, it would be desirable to provide a bowling ramp that combines all the previous mentioned elements together in a single, unique, easily transportable, and easily stored bowling ramp apparatus.

DISCLOSURE OF INVENTION

An object of the present invention is to provide a bowling ramp with a unique aiming device that can be easily set up for operation and conveniently to target specific pins without the need for repositioning the entire ramp after each throw.

Another object of the present invention is to provide a bowling ramp having a smooth transition in the path of movement of the ball from the ramp to the lane surface.

A further object of the present invention is to provide a bowling ramp that can safely accommodate bowling balls of all standard weights.

A still further object of the present invention is to provide a bowling ramp with adjustable ball positions to allow persons of minimal strength to be able to bowl.

Another object of the present invention is to provide a bowling ramp that is foldable to a smaller size for ease of transport and storage.

To obtain the above objects, a unique, one-piece, free standing bowling ramp is disclosed. The bowling ramp includes supporting means, positioning and accelerating means, and aiming means. The supporting means include a base consisting of one or more interconnected primarily horizontal components in contact with the bowling surface as well as retractable and securable flaps for laterally stabilizing the ramp. Elastomeric padding and gripping material is preferably placed underneath the base of the ramp and flaps to provide stability during bowling and protect the bowling alley surface from scratching.

The supporting means includes a cut out portion. The cut out portion is used for aligning the bowling ramp with the bowling lane.

The positioning and accelerating means include parallel sloped rails having variable slope. The rails extend from the top of the bowling ramp to the surface upon which the bowling ramp rests. At the upper portion of the ramp where the bowler places the ball, the rails are upwardly sloped so as to prevent the ball from rolling down the ramp before the bowler begins to bowl. At the upper end of the ramp, adjacent to where the ball is positioned, the rails become downwardly sloped. The slope of the ramp provides the ball with enough acceleration to knock down bowling pins at the end of the bowling lane. The rails are preferably sloped in such a way that the motion of the ball, during the transition from the ramp to the floor surface, is smooth.

The rails are also equipped with a variable position ball stop at the upper portion of the ramp. This allows the bowler to choose the distance that the ball is placed from the upper end of the ramp.

Unique aiming means are provided which consist of a clamping device for locking the rails onto the base to target specific pins. The bowler simply adjusts the direction of the rails by moving a handle to target specific pins. The clamping device locks the position of the rails to the base. A guide chart can be utilized to aid the bowler in the aiming process needed for knocking down specific pins, such as when returning to pick-up a spare with a second ball.

The above objectives, features, and advantages of the current embodiment of the invention are readily apparent from the following detailed description of the best mode for carrying out the invention when taken in conjunction with the accompanied drawings.

BEST MODE FOR CARRYING OUT THE INVENTION

Figure 1:
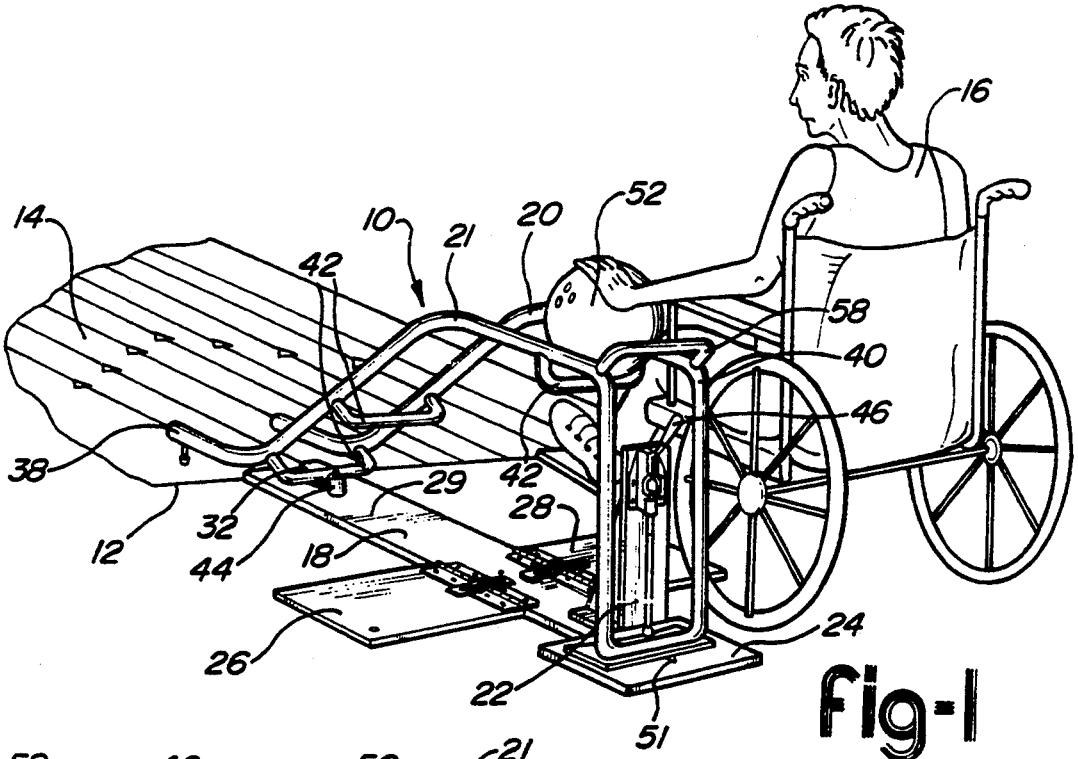
FIG. 1 is a perspective view of the bowling ramp and a representative bowler in position to use the ramp in accordance with the invention.

Referring to FIG. 1, a bowling ramp 10 is generally illustrated. The bowling ramp 10 is aligned with a foul line 12 of a bowling lane 14. A bowler 16 is shown in the proper position to use the bowling ramp 10. The bowler 16 may be positioned on either side of the bowling ramp 10, either seated such as in a wheel chair or standing up either beside or in back of the ramp.

Figure 2:
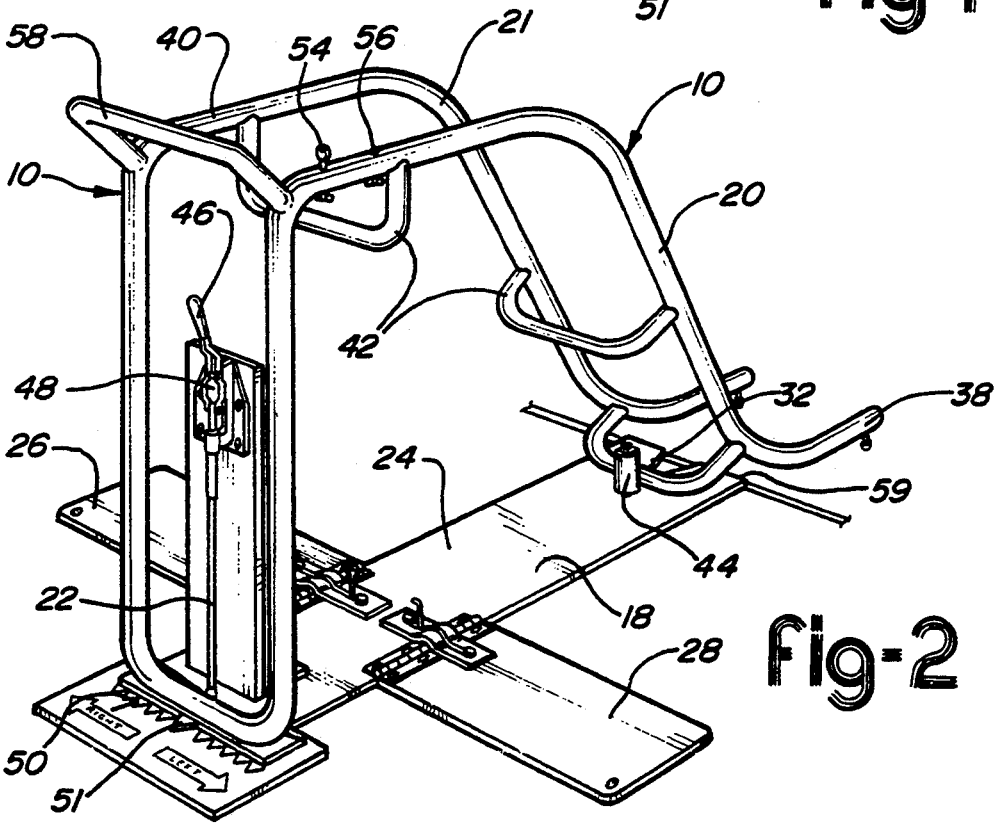
FIG. 2 is a perspective view of the bowling ramp.
Figure 5:
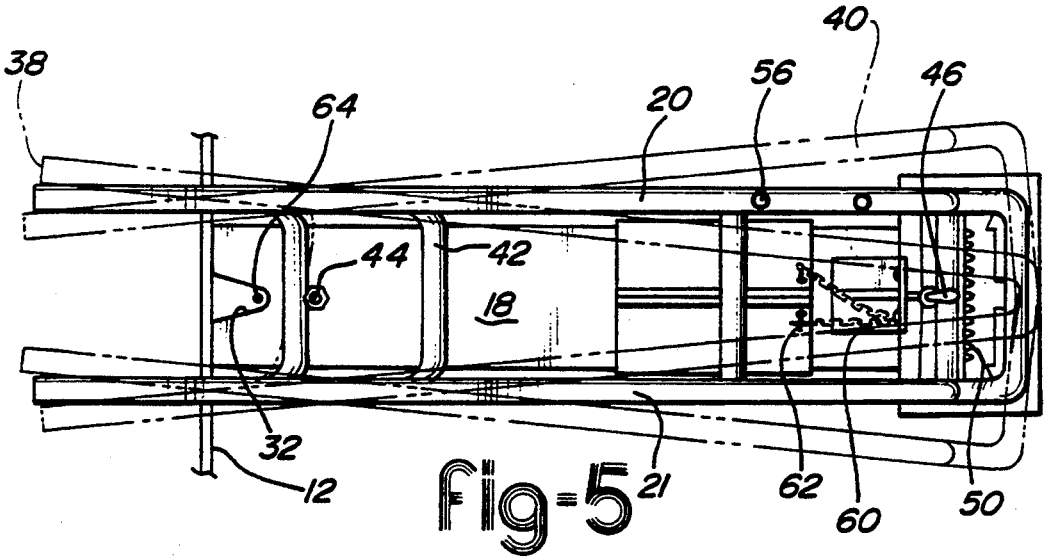
FIG. 5 is a top view of the bowling ramp showing a range of possible aiming directions.

FIG. 2 shows the bowling ramp 10 construction in further detail. The bowling ramp 10 includes base 18, right and left guide rails 20 and 21, and aiming and locking mechanism 22. Base 18 includes one or more plates 24 and retractable flaps 26 and 28. Plate or plates 24 as well as the flaps 26 and 28 are adapted to be supported on the bowling lane surface 14. A gripping pad 30, preferably composed of an elastomeric material, is provided on the under side of the flaps 26 and 28 and the plate 24. The front of the plate 24 contains a notch or cut out portion 32 for use in aligning the bowling ramp 10 which is also shown in FIG. 5. Right and left rails 20 and 21 each have a forward portion 38 and a rearward portion 40. Braces 42 connect right and left rails 20 and 21. Aiming and locking mechanism 22 attaches the guide rails 20 and 21 to the base 18. The guide rails 20 and 21 are also connected to the base 18 by a pivot 44. Aiming and locking mechanism 22 includes a clamp 48 and a guide chart 50 and arrow 51.

Figure 4:
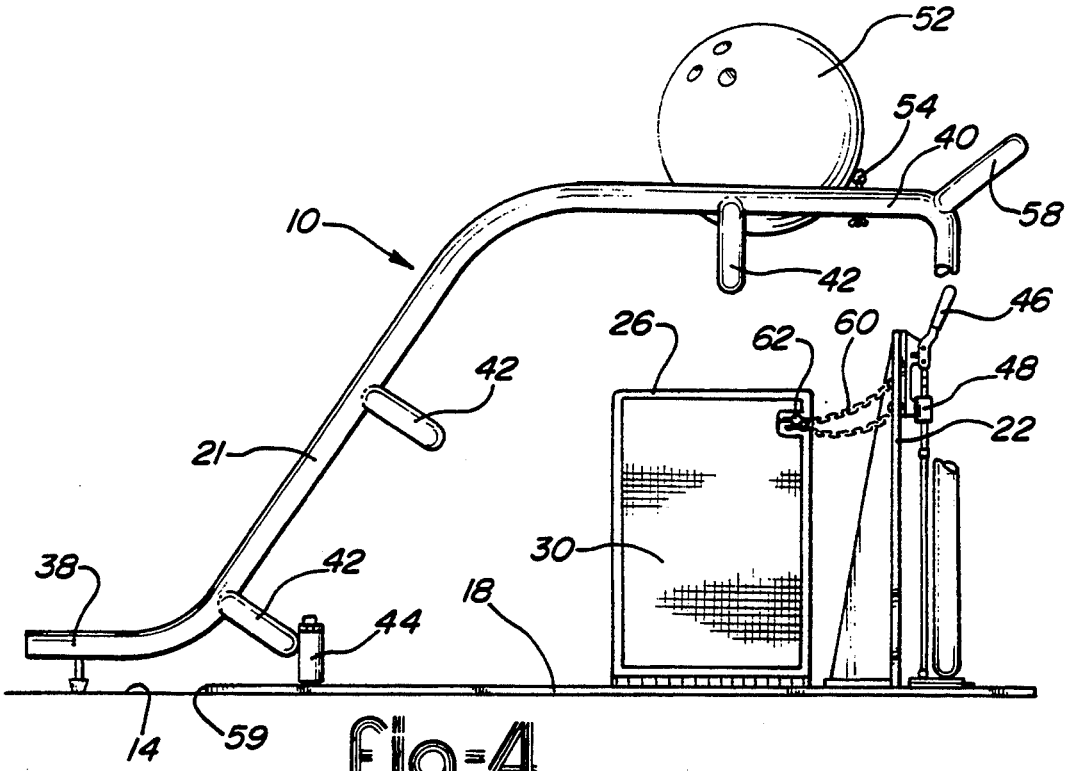
FIG. 4 is a side view of the bowling ramp showing the ball position prior to being urged down the ramp and the flaps in their foled position.

Referring to FIG. 4, a bowling ball 52 is shown positioned on the bowling ramp 10. More specifically, the bowling ball 52 is shown in a stationary position on the rearward portion 40 of the guide rails 20 and 21. Rearward portion 40 is slightly inclined in the rearward direction to prevent accidental ball release before the bowler is ready to bowl. The forward portion 38 is sloped downwardly in the forward direction to accelerate the bowling ball 12. The lower end of forward portion 38 includes a transition curve portion providing a smooth transition in the path of motion of the bowling ball 52 as it approaches the bowling lane 14. A pin 54 is received in one of several holes 56 shown in FIGS. 2 and 5, to keep the bowling ball 52 from rolling backward past the desired starting position. Pin 54 can be placed at different distances from a U-shaped handle 58 which is used to aim the guide rails 20 an 21.

Referring now to FIG. 5, the wide range of adjustment of the bowling ramp 10 is shown. By swiveling the handle 58, the guide rails 20 and 21 can be rotated relative to the base 18 about pivot 44 to target specific pins. The front edge 59 of the base 18 is preferably aligned with the foul line 12 of the bowling lane 14.

In FIGS. 4 and 5, flaps 26 and 28 are shown in their retracted position. A chain 60 and a locking pin 62 secure the flaps 26 and 28 in their retracted position.

Figure 6:
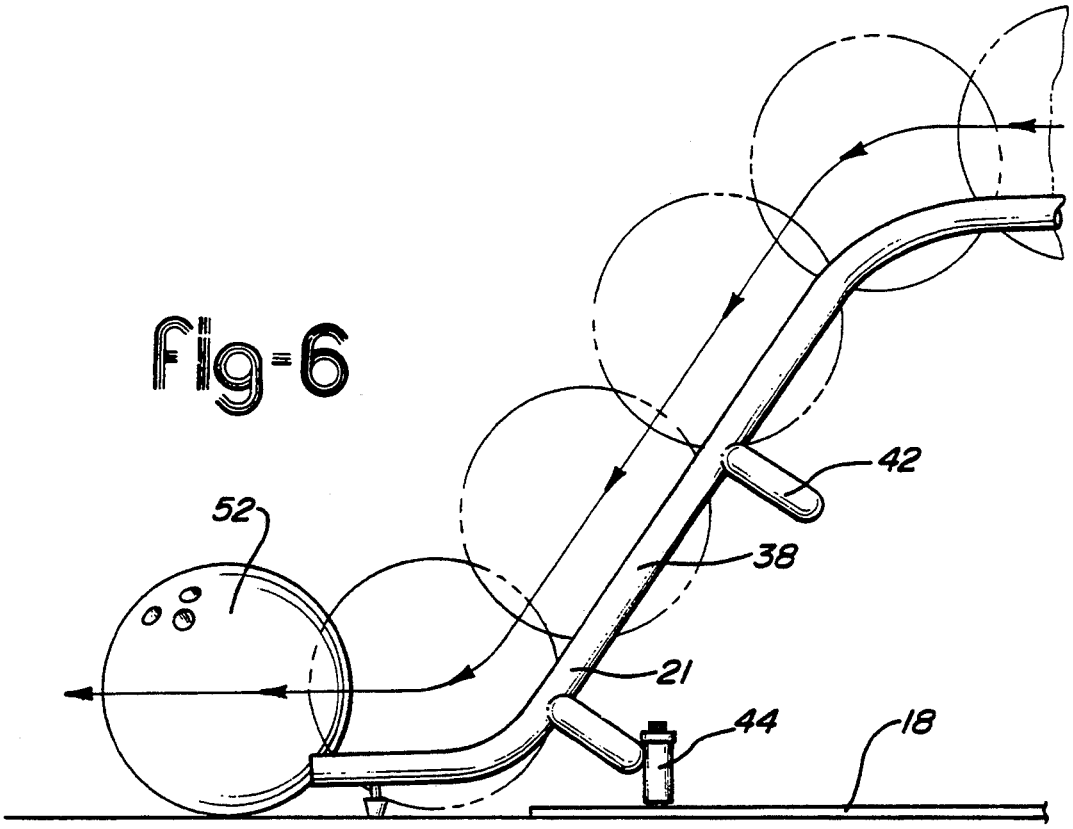
FIG. 6 is a side view of the bowling ramp showing the descent of the ball as it progresses down the ramp.
Figure 7:
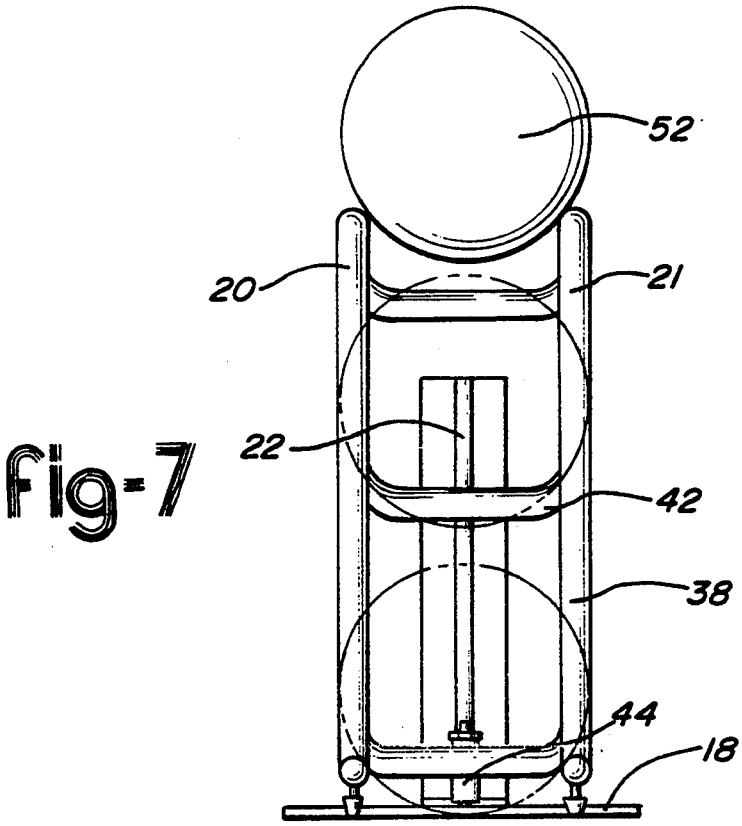
FIG. 7 is a front view of the bowling ramp also showing the descent of the ball down the ramp.

FIGS. 6 and 7 show the path of the bowling ball 52 as it rolls down the bowling ramp 10. More specifically, FIG. 6 shows the downward motion of the bowling ball 52 and the portion of the bowling ball 52 as it leaves the guide rails 20 and 21 and is directed down the bowling lane 14. As a result of the structure of the guide rails 20 and 21, the motion imparted to the ball is substantially smooth.

Use of the bowling ramp 10 will now be described. First, the bowling ramp 10 must be aligned with the foul line 12 of the bowling lane 14. More specifically, as shown in FIGS. 1 and 5, a dot 64 on the bowler's side of the foul line 12 must be visible in a notch 32 located on the planar member 24. Next, referring to FIG. 4, locking pin 62 is removed allowing the flaps 26 and 28 to be placed in the deployed position. Flaps 26 and 28 are then positioned flat on the bowling lane 14 with the gripping pad 30 in contact with the bowling lane 14. Flaps 26 and 28 are then locked into their deployed position as shown in FIGS. 1 and 2 with the flaps substantially coplanar with the planar member or members. Once properly positioned, the base 18 need not be moved again and the bowling ramp 10 is ready for use.

Figure 3:
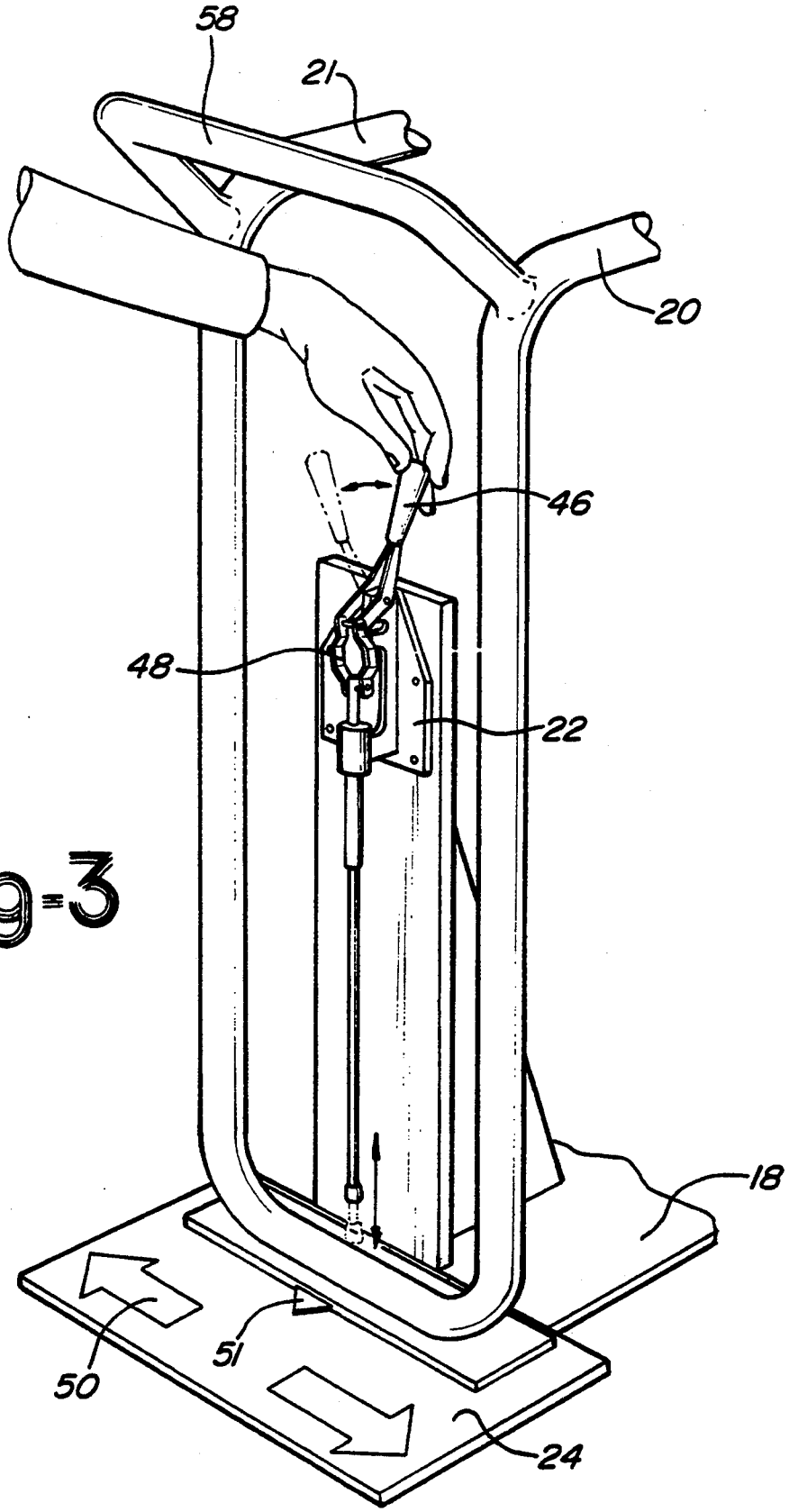
FIG. 3 is a perspective fragmentary view of the aiming mechanism incorporated in the bowling ramp and the clamp assembly that locks the rails to the base.

To target specific pins, the bowler must first unlock the clamp 48 by raising a clamp 48 as shown in FIG. 3. The bowler can freely swivel the bowling ramp 10 upon the pivot 44, grasping the handle 58 until the arrow 51 points to a specific point on the guide chart 50. To secure the desired aim, the clamp 48 is moved into a holding position by pressing down on the clamp 48. Referring to FIG. 3 the clamp 48 is shown in solid lines in the released position and with phantom lines in the locked position.

Next, the bowler selects the appropriate bowling ball 52, and places it on top of the bowling ramp 10. The bowling ramp 10 preferably has at least two positions for locating the bowling ball 52. One position is closer to the forward portion 38 of the bowling ramp 10, for bowlers who can barely push the ball 52. The second position is located further from the forward portion 38, for bowlers who are physically able to push the ball 52 with greater strength. Pin 54 may be repositioned so as to allow the bowler 16 to select either starting position. The bowler 16 is now ready to roll the ball 52 down the bowling ramp 10.

Upon push by the bowler, the bowling ball 52 descends down the bowling ramp 10. The ball 52 accelerates as it rides down the pair of rails 34 and 36. The bowling ball 52 exits the bowling ramp 10 and proceeds down the bowling lane 14 to the pins 54. The varying slope of the rails 36 and 38 causes the motion of the ball to be smooth, thereby eliminating bouncing on the bowling lane 14. To reposition guide rails 20, the clamp 48 is loosened by raising the handle 58. By using the U-shaped handle 46, the guide rails 20 can be swiveled to target different pins. Once the guide rails 20 are repositioned satisfactorily, the guide rails are locked into place by once again pulling down on the clamp handle 38. The guide chart is a simple aiming mechanism to take the guess work out of targeting specific pins.

When the bowler 16 is finished bowling, the bowling ramp 10 can be partially collapsed for ease of carrying and storing. First, the retractable flaps 26 and 28 are folded. Next, the locking pin 62, which is attached to the chain 60, is inserted into the hole 66. Finally, the clamping device 48 is placed in the closed position. With the flaps 26 and 28 folded up, the locking pin 62 in place, and the clamping device 48 secured, the bowling ramp 10 is prepared to be moved and stored.

While the best mode for carrying out the invention has been described in detail, along with the advantages present in the current embodiment of the invention, those familiar with the art to which the invention relates will recognize various alternative designs and embodiments for practicing the invention as defined by the following claims.

What is claimed is:

1. A ramp apparatus for accelerating a bowling ball along a bowling lane toward bowling pins comprising:

a base adapted to be positioned with respect to the bowling lane;

a pair of guide rails for accelerating a bowling ball toward the bowling pins, the guide rails having one end pivotably attached to one end of the base and an opposite end slidably connected to the other end of the base for adjusting the one end about the pivot to aim the bowling ball toward selected ones of the bowling pins; and an aiming and locking mechanism for alternately aiming the acceleration of a bowling ball toward selected bowling pins and securing the opposite end of the guide rails to the base.

2. The ramp apparatus of claim 1, wherein said base is planar so that it may contact the bowling lane and further comprises:

a flap hinged to an edge of said base and movable between a folded position away from the bowling lane and a deployed position wherein the flap lies in the same plane as the base for stabilizing said ramp.

3. The ramp apparatus of claim 2, wherein said flap and said base further comprise elastomeric gripping material attached to the portion of said flaps and said base which may be in contact with the bowling lane.

4. The ramp apparatus of claim 3, wherein said flap further includes bracket means for securing said in a retracted position.

5. The ramp apparatus of claim 4, wherein said flap further includes a hold down lock to prevent movement of the flap in the deployed position.

6. The ramp apparatus of claim 1, wherein said guide rails have a steep slope portion and a transition curved portion located at a lower end of the steep slope portion, said transition curve portion terminating at the end of the guide rails from which the ball is discharged toward the bowling pins.

7. The ramp apparatus of claim 6 wherein said guide rails have an upper support portion sloping downwardly toward said opposite end of the guide rails to prevent the ball from prematurely accidentally being accelerated by the guide rails toward the bowling pins.

8. The ramp apparatus of claim 7, wherein the upper support portion of said guide rails has means for variably positioning the ball along the length of the upper support portion.

9. The ramp apparatus of claim 1, wherein said aiming and locking mechanism comprises:

a handle for selectively pivoting said guide rails to target specific pins; and a clamp for locking and unlocking said guide rails in a selected position relative to the other end of the base.

10. The ramp apparatus of claim 1, further comprising:

a guide chart located on one of the base and the guide rails; and a pointer attached to the other of the base and the guide rails to indicate relative movement of the rails with respect to the base.

* * * * *